US010058977B2

(12) United States Patent
Adan

(10) Patent No.: US 10,058,977 B2
(45) Date of Patent: Aug. 28, 2018

(54) COMBINATION VENTURI MEDIA BLASTER AND WATER BLASTER ASSEMBLY

(71) Applicant: Andy Adan, Davis, CA (US)

(72) Inventor: Andy Adan, Davis, CA (US)

(73) Assignee: DTA Industries LLC, Minden, NV (US)

( * ) Notice: Subject to any disclaimer, the term of this patent is extended or adjusted under 35 U.S.C. 154(b) by 0 days.

(21) Appl. No.: 14/961,721

(22) Filed: Dec. 7, 2015

(65) Prior Publication Data

US 2016/0158915 A1 Jun. 9, 2016

Related U.S. Application Data

(60) Provisional application No. 62/088,612, filed on Dec. 7, 2014.

(51) Int. Cl.

| | |
|---|---|
| ***B24C 3/06*** | (2006.01) |
| ***B24C 1/00*** | (2006.01) |
| ***B24C 5/02*** | (2006.01) |
| ***B24C 7/00*** | (2006.01) |
| ***B24C 11/00*** | (2006.01) |

(52) U.S. Cl.

CPC ..... *B24C 3/06* (2013.01); *B24C 1/00* (2013.01); *B24C 5/02* (2013.01); *B24C 7/0084* (2013.01); *B24C 11/005* (2013.01)

(58) Field of Classification Search

CPC ..... B24C 5/02; B24C 7/0084; B24C 11/005; B24C 3/06; B24C 1/00

USPC ..... 451/90, 38, 102, 75, 99, 39, 40; 239/270, 544, 572, 87, 86, 650, 103

See application file for complete search history.

(56) References Cited

U.S. PATENT DOCUMENTS 520,766 A * 6/1894 Bryce ..... B05B 7/2437 239/143

4,698,940 A * 10/1987 Zwicker ..... B24C 5/02 137/527

(Continued)

FOREIGN PATENT DOCUMENTS

WO 97/49525 A1 12/1997

OTHER PUBLICATIONS

Kennametal, "Abrasive Blast Nozzles",pp. 1-84, Kennametal Inc. (2012).

(Continued)

*Primary Examiner* — Monica Carter
*Assistant Examiner* — Katina Henson
(74) *Attorney, Agent, or Firm* — Temmerman Law Office; Mathew J. Temmerman

(57) ABSTRACT

An abrasive media blaster assembly includes a container to hold at least one abrasive media, an external air source to provide a compressed air supply, a reservoir to hold water and rust inhibitor solution and a venturi blaster gun. The venturi blaster gun comprises an exterior nozzle, a media blaster block and a trigger with a handle. The fittings in the media blaster block create a venturi effect and draw the water and rust inhibitor solution so as for it to mix with the abrasive media where the dustless blaster sprays the mix to remove surface finishes from a metal surface and simultaneously provides a rust inhibitor to the surface, thereby allowing the device to be capable of performing any one, two or all of dry media blasting, slurry blasting, and water blasting.

5 Claims, 7 Drawing Sheets

(56) References Cited

U.S. PATENT DOCUMENTS

| | | | | |
|---|---|---|---|---|
| 4,709,515 | A * | 12/1987 | Copeland | B24C 5/04 222/132 |
| 5,312,040 | A | 5/1994 | Woodward | |
| 5,407,379 | A | 4/1995 | Shank et al. | |
| 5,725,154 | A * | 3/1998 | Jackson | B08B 3/026 239/135 |
| 6,386,949 | B1 * | 5/2002 | Hagiwara | B24C 1/086 451/40 |
| 6,623,154 | B1 * | 9/2003 | Garcia | B01F 5/0415 137/888 |
| 2014/0170937 | A1 | 6/2014 | Sugimoto et al. | |

OTHER PUBLICATIONS

"Suction or Depression System", Copyright © 2016 Surfanet, www.surfanet.org/uk/processes/suction-or-injection, unknown publication date, retrieved Jan. 5, 2016.

"Industrial Sandblasting—Where Does All the Air Go?", Don van Ormer & Scott van Ormer, Air Power USA, www.airbestpractices.com/industries/metals/industrial-sandblasting—where-does-all-air-go, unknown publication date, retrieved Jan. 5, 2016.

"Siphon Nozzle for Waste Oil Burner", Landshark Labs, www.youtube.com/watch?v=ZEBc0_cSoh4&spfreload=10, published Mar. 16, 2010, retrieved Jan. 5, 2016.

* cited by examiner

COMBINATION VENTURI MEDIA BLASTER AND WATER BLASTER ASSEMBLY

RELATED APPLICATIONS

This application claims priority from the U.S. provisional application with Ser. No. 62/088,612, which was filed on Dec. 7, 2014. The disclosure of that provisional application is incorporated herein as if set out in full.

BACKGROUND OF THE DISCLOSURE

Technical Field of the Disclosure

The present embodiment relates in general to abrasive blasting equipment for preparing metal surfaces for painting; and more particularly to a dustless blaster that eliminates the need for a pressurized tank and is adaptable for installation in any location with a compressed air supply.

Description of the Related Art

Abrasive blasting is the operation of forcibly propelling a stream of abrasive material against a rough surface under high pressure to smooth the rough surface and to remove surface contaminants. In conventional abrasive blasting methods, the abrasive material used is dry and finely-divided. In these methods, large amounts of dust containing silica are emitted into the atmosphere. If inhaled, this dust can stick to the lung tissue potentially causing severe health problems.

For example, one of the existing conventional blasting methods provides a light weight mechanism that can be conveniently carried in the hand of the user with a pneumatic air gun through which a high velocity air stream can flow, thereby delivering a stream of dry granular abrasive material. In this apparatus, the abrasive material moves at a low velocity when compared with the intended high velocity of an air stream, to prevent undue wear upon the metallic surfaces of the conduit through which the material passes when discharged. In this method, as stated above, a large amount of dust is emitted into the atmosphere.

In order to overcome the drawbacks of the aforementioned method, dustless abrasive blasting methods have been developed. In the dustless abrasive blasting method, an abrasive element is entrained in a pressurized liquid flow and then directed through a nozzle. Current dustless blasters must have a pressurized system that requires EPA/OSHA standard pressurized tanks, thereby requiring more time and energy to set up and operate. Dustless methods are traditionally very expensive and difficult to set up.

Another existing blasting apparatus includes a pressure vessel adapted to contain a particulate blasting medium and a liquid. The vessel includes an inlet and a bottom outlet. The interior of the vessel communicates via its bottom outlet with an opening in a conduit through which an entraining pressurized mixture of media and fluid can be fed from a pressurized gas source. A pressurizing device is provided to pump liquid into the vessel and through the bottom outlet. Immediately upstream of the opening in the conduit is located a venturi so that the velocity of the pressurized gas is increased as it passes over the opening thereby increasing the quantity of particulate blasting medium entrained by the gas. However, the pressure vessel of the apparatus is traditionally very expensive and difficult to set up.

Yet another method describes a fluid-jet-abrasive device having a fluid-jet gun with a trigger adapted to operate a pressure-control valve, to allow fluid to flow through and pass out of the spray-nozzle of the gun under extremely high pressure and velocity. The fluid is under pressure supplied through an interconnected flow system with a water-tank reservoir, a pumping unit coupled at one end to the water tank and at the opposite end to the pressure inlet of the gun through a recirculating conduit system. The gun includes a separate inlet port through which various types of abrasive materials are passed and mixed with the fluid to be sprayed under high pressure. The abrasive material is stored in a tank with a material-flow regulator attached to automatically control the amount of the abrasive material delivered to the gun. In addition to sharing drawbacks with some other conventional systems is the lack of any feature that provides for rust inhibition.

Therefore, there is a need for a dustless blaster that would provide paint stripping, rust removal, and metal preparation for paint with minimal effort. Such a dustless blaster would eliminate the need for a pressurized tank. It would be cost effective and adaptable to being setup in any location with an air supply. Further, such a needed dustless blaster would use silica free media and would function with air and water supply. In addition, this blaster would utilize a venturi to siphon water and media which would automatically mix within an exterior nozzle to provide a rust inhibiting coating. The present embodiment overcomes existing shortcomings of dustless blasters by accomplishing all of these objectives.

SUMMARY OF THE DISCLOSURE

To minimize the limitations found in the prior art, and to minimize other limitations that will be apparent upon the reading of this specification and review of the attendant drawings, the preferred embodiment of the present invention provides a venturi media blaster assembly for preparing a metal surface for painting.

The venturi media blaster assembly comprises a container, an external air source, a reservoir and a venturi blaster gun. The container is adapted to contain at least one abrasive media. The container comprises an outlet and is connected to a first valve member, a first tube member having a first end and a second end and a second tube member having a first end and a second end. The first end of the first tube member is connected to the first valve member and the second end of the first tube member is adapted to allow ambient air to pass therethrough from the atmosphere. The ambient air passed through the first tube member pushes the at least one abrasive media released from the container at the first valve member. The first end of the second tube member is connected to the first valve member and the second end is connected to the venturi blaster gun. The reservoir is adapted to hold water and rust inhibitor solution. The reservoir having a reservoir tube includes a first end and a second end. The first end of the reservoir tube is connected to the reservoir. The venturi blaster gun comprises an exterior nozzle, a media blaster block and a trigger with a handle. The external air source is connected to the venturi blaster gun using an air supply tube that includes an air outlet and an air inlet.

The exterior nozzle has a proximal end and a distal end. The media blaster block is attached to the proximal end of the exterior nozzle. The media blaster block has a top wall, a bottom wall, a pair of left and right side walls, a left end wall, an interior wall and a right end wall. The bottom wall of the media blaster block has a first inlet connected to the air inlet of the air supply tube to receive air from the external air source, a second inlet connected to the second end of the second tube member to receive the at least one abrasive media from the container via a second valve member and a third inlet is connected to the second end of the reservoir tube to receive water and rust inhibitor solution from the reservoir via a third valve member. The left sidewall of the media blaster block includes an aperture to receive a left pinch knob and the right side wall comprises an aperture to receive the right pinch knob. The left end wall of the media blaster block includes a left aperture to receive the exterior nozzle. The right end wall receives a fourth valve member that engaged to a spring plunger. The interior wall has a first orifice, a second orifice and a third orifice. The first orifice is connected to an interior nozzle extended through the left aperture of the left end wall and the proximal end of the exterior nozzle to allow the flow of air from the first inlet of the bottom wall to the exterior nozzle. The second orifice is adapted to allow the flow of media from the second inlet of the bottom wall to the exterior nozzle and the third orifice is adapted to allow the flow of water and rust inhibitor solution from the third inlet of the bottom wall to the exterior nozzle and the third orifice is adapted to allow the flow of water and rust inhibitor solution from the third inlet of the bottom wall to the exterior nozzle. The right and left pinch knobs allow the regulation of the flow of media and water received from the second inlet and third inlet of the bottom wall utilizing the second valve member and the third valve member respectively. The special design of the interior nozzle creating the venturi effect and helps to prevent the premixing of air with water and rust inhibitor solution and the abrasive media. When the media blaster block is assembled to the exterior nozzle, the fitting is appropriately placed within exterior nozzle to create the siphon effect. The venturi media blaster assembly uses venturi to siphon water and media and mix them automatically within media blaster block and provides a dustless blast. When the trigger is pulled, the spring plunger is actuated, the fourth valve member opens and the pressurized air enters from the first inlet of the bottom wall through the interior nozzle creating the venturi effect for propelling the media and the water and the rust inhibitor solution discharged from the second orifice and the third orifice to the exterior nozzle thereby mixing the media and water and the rust inhibitor solution to provide a dustless blast which is expelled out through the exterior nozzle. In this way, the plunger/deadman valve will regulate the air flow. The venturi blaster gun is designed to utilize the venturi effect to bring the water and rust inhibitor solution and mix with the abrasive media to provide the dustless blaster the capability to spray preferably metal and remove all surface finishes and oxidation.

It is a first objective of the present invention to provide a dustless blaster that would provide paint stripping, rust removal, and metal preparation for paint with minimal effort.

A second objective of the present invention is to provide a unique design for eliminating the need for a pressurized tank.

A third objective of the present invention is to provide an inexpensive system that can be set up in any location with an air supply.

Yet another objective of the present invention is to provide a venturi media blaster that utilizes the venturi effect to bring the water solution and mix with the media to provide the dustless blaster the capability to spray preferably metal and remove all surface finishes and oxidation.

Still another objective of the present invention is to provide air supply to the venturi blaster gun, water and rust inhibitor solution and media are siphoned and mix them automatically within the exterior nozzle to create a dustless blast.

These and other advantages and features of the present invention are described with specificity so as to make the present invention understandable to one of ordinary skill in the art.

BRIEF DESCRIPTION OF THE DRAWINGS

In order to enhance their clarity and improve understanding of these various elements and embodiments of the invention, elements in the figures have not necessarily been drawn to scale. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below. Finally, many of the steps are presented below an order intended only as an exemplary embodiment. Unless logically required, no step should be assumed to be required earlier in the process than a later step simply because it is written first in this document.

Figure 1:
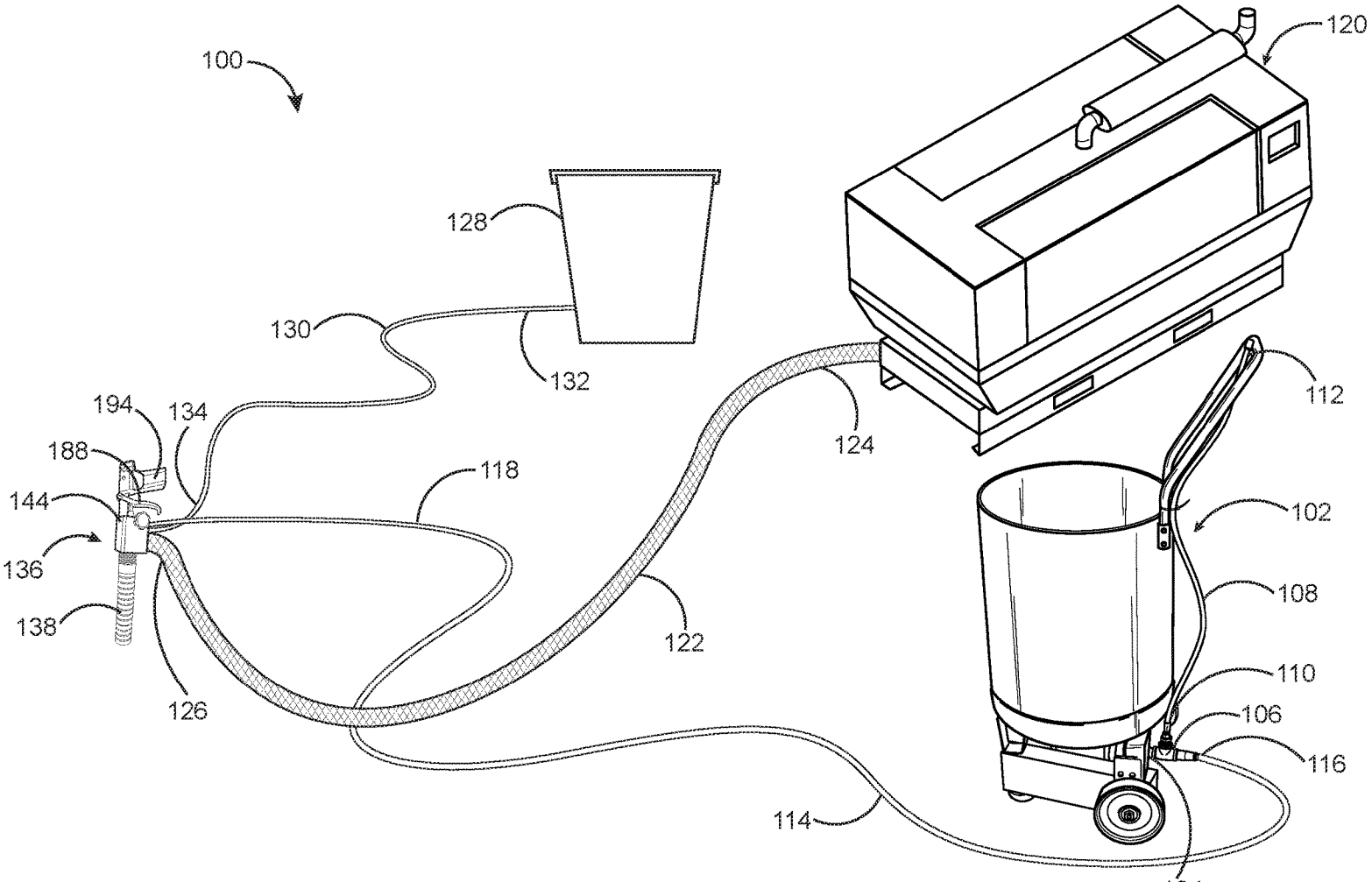
FIG. 1 illustrates an exemplary view of various elements of a venturi media blaster assembly in accordance with a preferred embodiment of the present invention.

Referring to FIG. 1, an exemplary view of various elements of a venturi media blaster assembly 100 in accordance with a preferred embodiment of the present invention is illustrated. The venturi media blaster assembly 100 comprises a container 102, an external air source 120, a reservoir 128 and a venturi blaster gun 136. The container 102 is adapted to hold at least one abrasive media. The container 102 includes an outlet 104 connected to a first valve member 106 and a first tube member 108. The first tube member 108 comprises a first end 110 and a second end 112. The first end 110 of the first tube member 108 is connected to the first valve member 106 and the second end 112 of the first tube member 108 is adapted to allow ambient air to pass therethrough from the atmosphere. In this way, it acts as a carburetor. Then, the ambient air passed through the first tube member 108 pushes the at least one abrasive media released from the container 102 at the valve member 106. The container 102 comprises a second tube member 114 having a first end 116 and a second end 118. The first end 116 of the second tube member 114 is attached to the first valve member 106.

The reservoir 128 is adapted to hold water and rust inhibitor solution. The reservoir 128 comprises a reservoir tube 130 including a first end 132 and a second end 134. The first end 132 of the reservoir tube 130 is connected to the reservoir 128. The venturi blaster gun 136 has an exterior nozzle 138, a media blaster block 144 and a trigger 188 with a handle 194. The external air source 120 connected to the venturi blaster gun 136 uses an air supply tube 122. The air supply tube 122 comprises an air outlet 124 and an air inlet 126. The air outlet 124 is connected to the external air source 120. The venturi blaster gun 136 is designed to utilize the venturi effect to bring the water and rust inhibitor solution and to mix with the abrasive media to provide the dustless blaster the capability to spray preferably metal so as to remove all surface finishes and oxidation therefrom.

Figure 2:
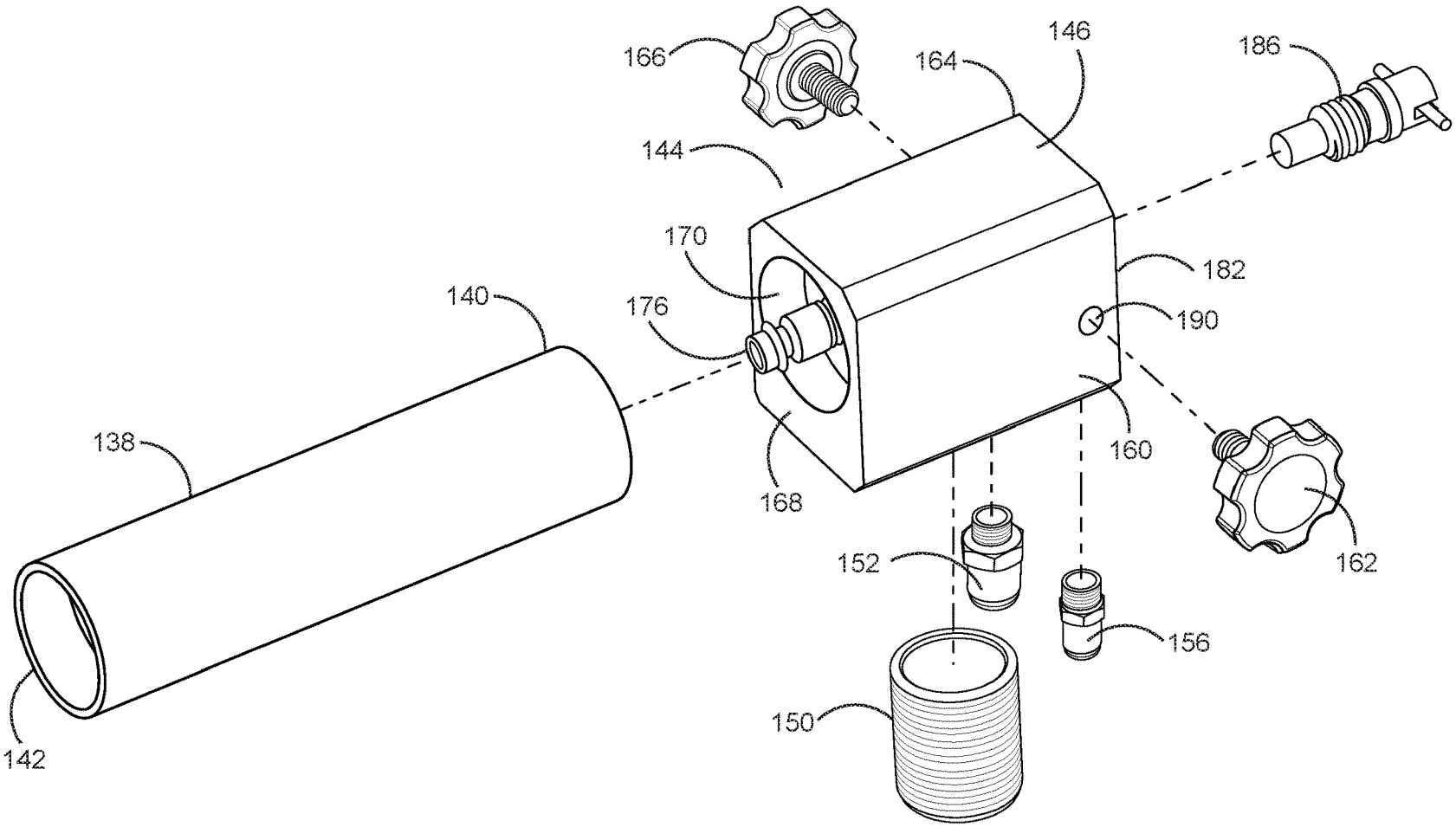
FIG. 2 illustrates an exploded view of a media blaster block connected to an exterior nozzle of the venturi media blaster assembly in accordance with the preferred embodiment of the present invention.

FIG. 2 illustrates an exploded view of the media blaster block 144 connected to the exterior nozzle 138 used in the venturi media blaster assembly 100 in accordance with the preferred embodiment of the present invention. The exterior nozzle 138 has a proximal end 140 and a distal end 142. The media blaster block 144 is attached to the proximal end 140 of the exterior nozzle 138. The media blaster block 144 has a top wall 146, a bottom wall 148 (See FIG. 3), a pair of left and right side walls (160, 164), a left end wall 168, an interior wall 172 (See FIG. 3) and a right end wall 182. The bottom wall 148 (See FIG. 3) of the media blaster block 144 comprises a first inlet 150 connected to the air inlet 126 of the air supply tube 122 to receive air from the external air source 120, a second inlet 152 connected to the second end 118 of the second tube member 114 to receive the at least one abrasive media from the container 104 via a second valve member 154 (See FIG. 4), and a third inlet 156 is connected to the second end 134 of the reservoir tube 130 to receive water and rust inhibitor solution from the reservoir 128 via a third valve member 158 (See FIG. 4). The left sidewall 160 of the media blaster block 144 comprises an aperture 190 to receive a left pinch knob 162 and the right side wall 164 comprises an aperture 192 (not shown) to receive the right pinch knob 166. The left end wall 168 of the media blaster block 144 includes a left aperture 170 to receive the exterior nozzle 138. The right end wall 182 receives a fourth valve member 184 (See FIG. 4) that is engaged to a spring plunger 186.

Figure 3:
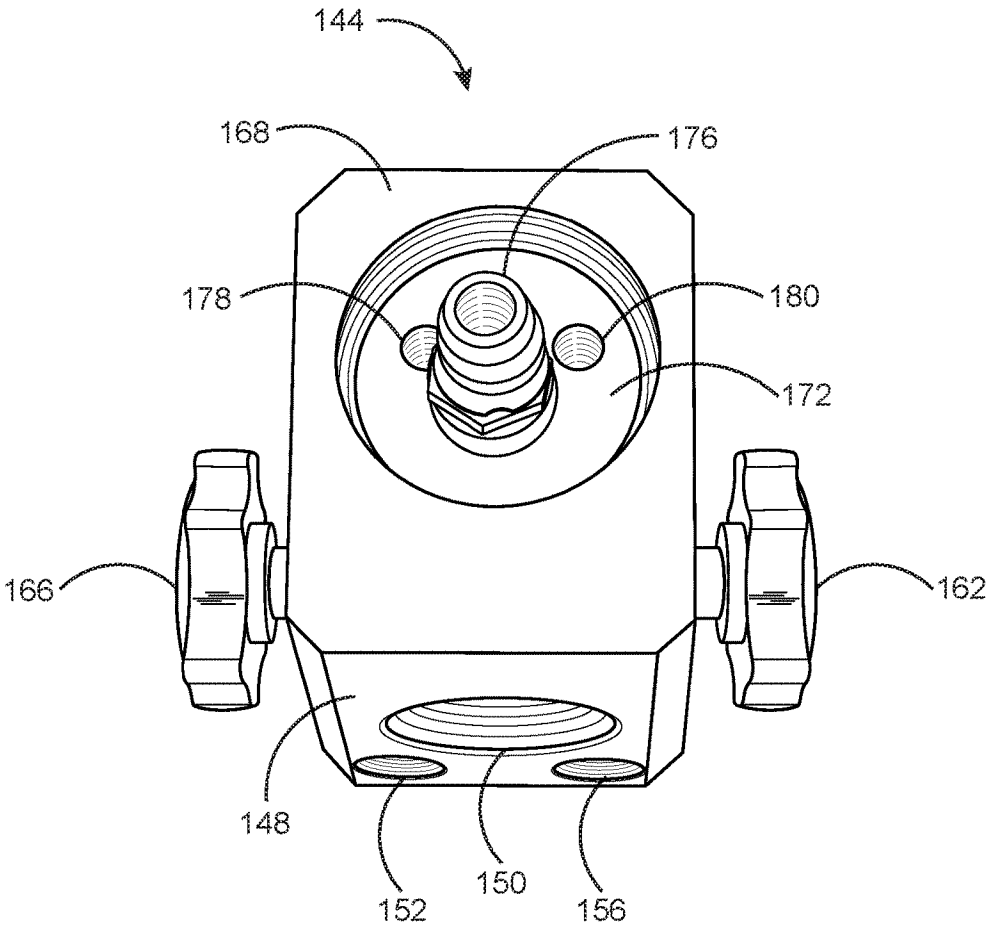
FIG. 3 illustrates an interior view of the media blaster block in accordance with the preferred embodiment of the present invention.

FIG. 3 illustrates an interior view of the media blaster block 144 in accordance with the preferred embodiment of the present invention. The interior wall 172 comprises a first orifice 174, a second orifice 178 and a third orifice 180. The first orifice 174 is connected to an interior nozzle 176 that extends through the left aperture 170 of the left end wall 168 and the proximal end 140 of the exterior nozzle 138 to allow the flow of air from the first inlet 150 of the bottom wall 148 to the exterior nozzle 138. The special ornamental design of the interior nozzle 176 creates the venturi effect and helps to prevent the premixing of air with water and rust inhibitor solution and the abrasive media. When the media blaster block 144 is assembled to the exterior nozzle 138, the fitting is appropriately placed within exterior nozzle to create the siphon effect. The venturi media blaster assembly 100 uses venturi effect to siphon water and media and mix them automatically within media blaster block 144 thereby providing a dustless blast.

Figure 4:
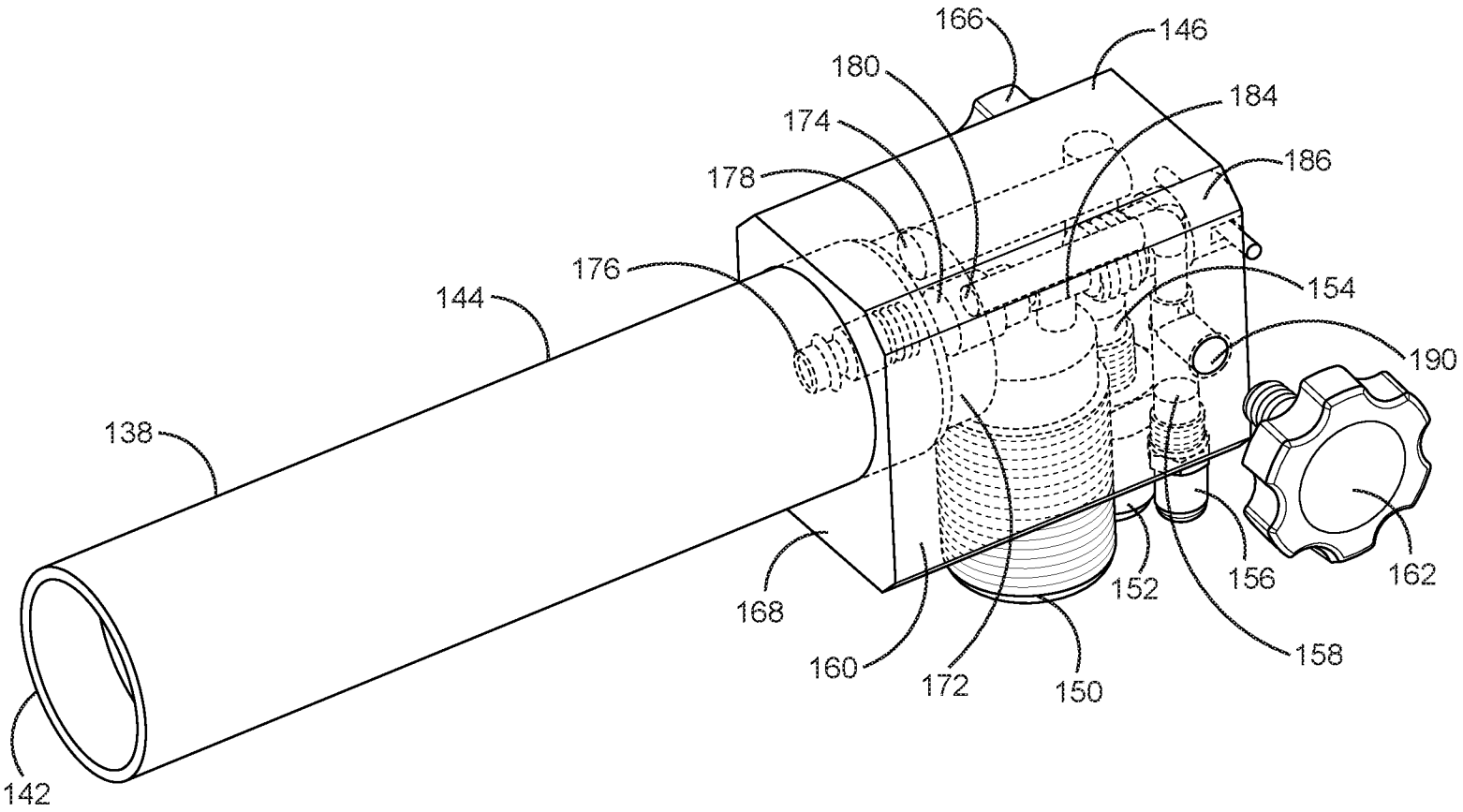
FIG. 4 illustrates a perspective view of the media blaster block connected to the exterior nozzle of the venturi media blaster assembly in accordance with the preferred embodiment of the present invention.

FIG. 4 illustrates a perspective view of the media blaster block 144 connected to the exterior nozzle 138 of the venturi media blaster assembly 100 in accordance with the preferred embodiment of the present invention. The first orifice 174 is connected to the interior nozzle 176 extended through the left aperture 170 of the left end wall 168 and the proximal end 140 of the exterior nozzle 138 to allow the flow of air from the first inlet 150 of the bottom wall 148 to the exterior nozzle 138. The second orifice 178 is adapted to allow the flow of media from the second inlet 152 of the bottom wall to the exterior nozzle 138. The third orifice is adapted to allow the flow of water and rust inhibitor solution from the third inlet 156 of the bottom wall 148 to the exterior nozzle 138. The right and left pinch knobs (166, 162) allow the regulation of the flow of the media and water received from the second inlet 152 and third inlet 156 of the bottom wall 148 utilizing the second valve member 154 and the third valve member 158, respectively. When the trigger 188 is pulled, the spring plunger 186 is actuated, the fourth valve member 184 opens and the pressurized air enters from the first inlet 150 of the bottom wall 148 through the interior nozzle 176, thereby creating the venturi effect for propelling the media and the water and the rust inhibitor solution discharged from the second orifice 178 and the third orifice 180 to the exterior nozzle 138 which in turn causes the mixing of the media and water and the rust inhibitor solution to provide a dustless blast. The venturi blaster gun 136 is designed to utilize the venturi effect to bring the water and rust inhibitor solution and mix with the abrasive media to provide the dustless blaster to spray metal and remove all surface finishes and oxidation. The unique design of the venturi media blaster gun 136 eliminates the need of any pressurized tanks and can be set up in any location with the air supply.

Figure 5B:
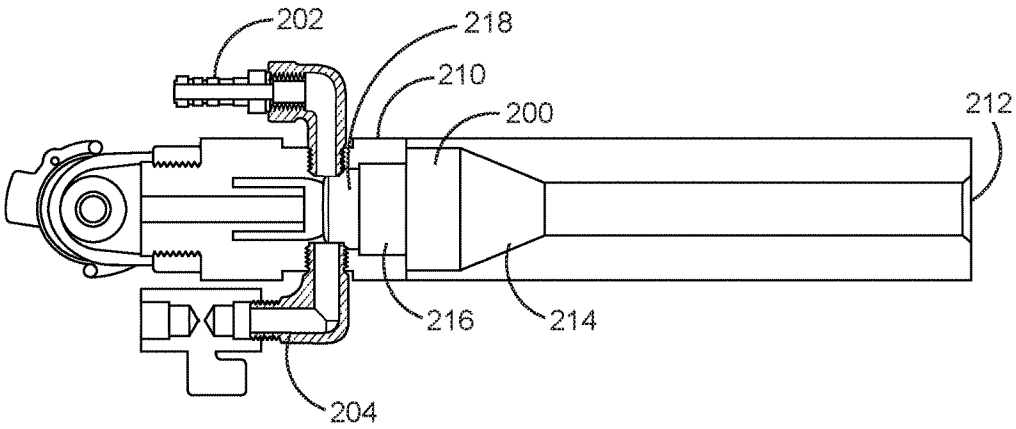
FIG. 5B illustrates a cross-sectional view of another embodiment of venturi blaster gun shown in FIG. 5A.
Figure 5A:
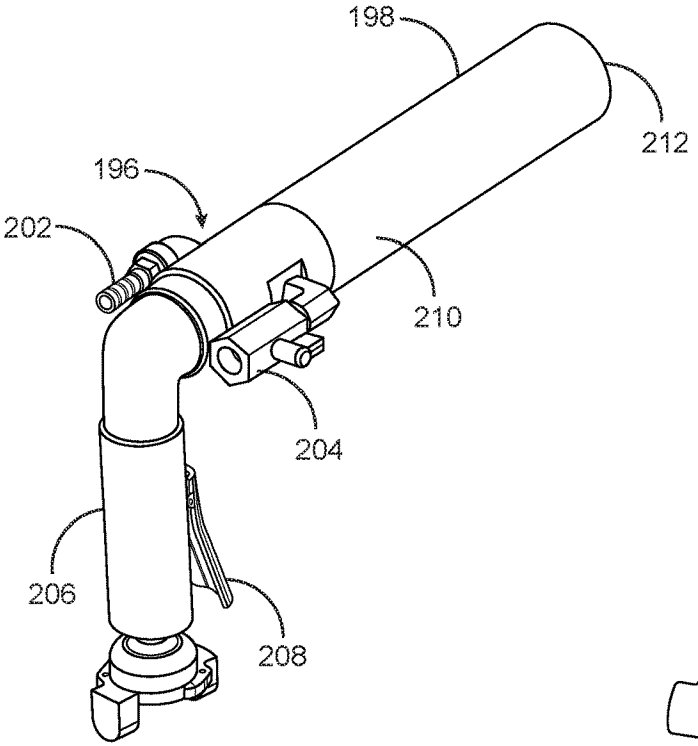
FIG. 5A illustrates a perspective view of another embodiment of a venturi blaster gun of the venturi media blaster assembly.

FIGS. 5A and 5B illustrate different views of an alternative embodiment of a venturi blaster gun 196 of the venturi media blaster assembly. In this embodiment, a venturi blaster gun 196 includes an exterior nozzle 198, a diffuser 200, a line to media 202, a line to water and rust inhibitor solution 204, and a pipeline 206 attached to a trigger 208. The exterior nozzle 198 comprises a proximal end 210 and a distal end 212. The proximal end 210 of the exterior nozzle 198 is connected to a first end 214 of the diffuser of the venturi blaster gun 196. A second end 216 of the diffuser is connected to a convergent area 218 of the line to media 202, the line to water and the pipeline 206 respectively. The line to media 202 is connected to the container 102 having the abrasive media. The line to water and rust inhibitor solution 204 is connected to a reservoir 128 having the water and rust inhibitor solution. The pipeline 206 is attached to the air supply tube 122 which is connected to an external air source 120. The air passes through the pipeline 206 to the diffuser 200 from the external air source 120. A venturi effect created by the air causes the media to be pulled into the venturi blaster gun 196 and mix with the water and rust inhibitor solution to provide a dustless blast.

Figure 6:
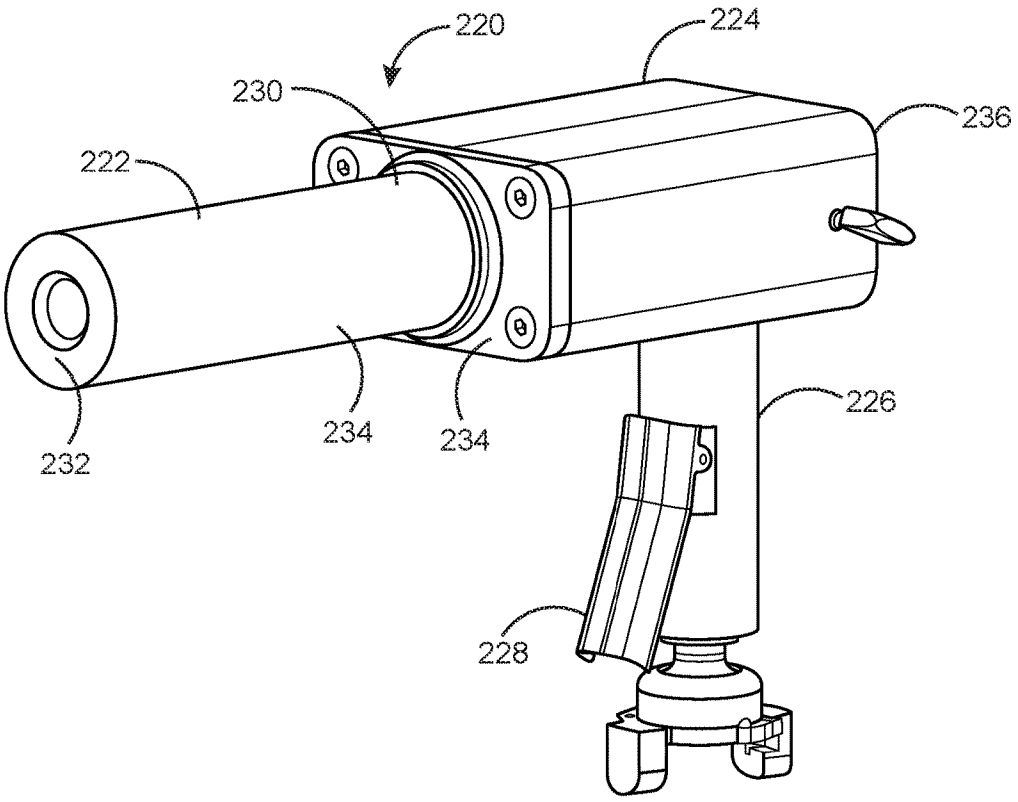
FIG. 6 illustrates a perspective view of another embodiment of venturi blaster gun of the venturi media blaster assembly in accordance with the present invention.

FIG. 6 illustrates a perspective view of another embodiment of a venturi blaster gun 220 of the venturi media blaster assembly in accordance with the present invention. The venturi blaster gun 220 includes an exterior nozzle 222, a media blaster block 224, and a pipeline 226 that is attached to a trigger 228. The exterior nozzle 222 has a proximal end 230 and a distal end 232. The media blaster block 224 includes a first end 234 and a second end 236. The first end 234 of the media blaster block 224 is connected to the proximal end 230 of the exterior nozzle 222. The pipeline 226 is attached to the air supply tube 122 which is connected to an external air source 120. The air is passed through the pipeline 226 to the media blaster block 224 from the external air source 120. A venturi effect created by the air causes the media to be pulled into the venturi blaster gun 220 and mix with the water and rust inhibitor solution to provide a dustless blast. The media blaster block 224 eliminates the need for external fittings and plumbs with a water and rust inhibitor solution and a media.

Figure 7:
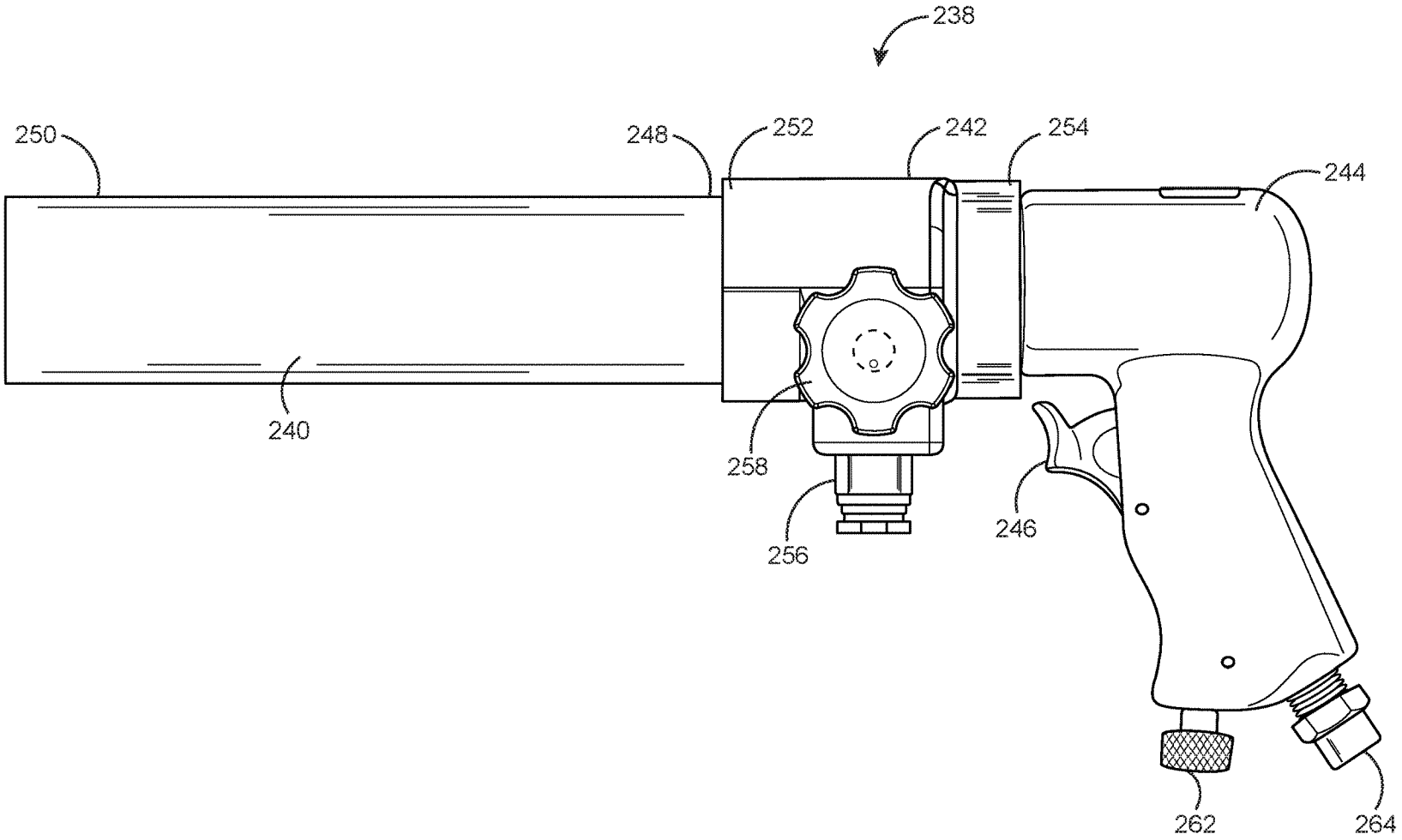
FIG. 7 illustrates a perspective view of another embodiment of the venturi blaster gun of the venturi media blaster assembly in accordance with the present invention.

FIG. 7 illustrates a perspective view of another embodiment of a venturi blaster gun 238 of the venturi media blaster assembly in accordance with the present invention. The venturi blaster gun 238 includes an exterior nozzle 240, a chamber 242 and a handle 244. The exterior nozzle 240 has a proximal end 248 and a distal end 250. The chamber 242 includes a first end 252, a second end 254, a media inlet 256 and a water inlet 266 (not shown). The media inlet 256 is connected to a container 102 and a water inlet 266 is connected to a reservoir 128. The flow of media and water is regulated by utilizing a left pinch knob 258 and a right pinch knob 268 (not shown) respectively. The first end 252 of the chamber 242 is connected to the proximal end 248 of the exterior nozzle 240 and the second end 254 is connected to the handle 244. The handle 244 includes an air inlet 264, a fourth valve member 262 and a trigger 246. The air is passed through the air inlet 264 to the chamber 242 from the external air source 120. A venturi effect created by the air causes the media to be pulled into the chamber 242 where it is mixed with a water and rust inhibitor solution to provide a dustless blast. Prior to that point, the water and media are kept separated until their arrival, at which time they are immediately mixed to create the dustless slurry. If it critical for the mixing to occur only in this area and not elsewhere in the system. The chamber 242 is also optimized to allow better mixture of the water and media to create the slurry. The handle 244 eliminates the need for a complex manifold block.

It is noted that the invention described herein is capable of performing dry media blasting, dustless slurry blasting and solely water blasting (such as when the air is not being pushed through). It is understood that no conventional blasting gun exhibits these capabilities prior to the present invention. Hence, dry media blasting, slurry blasting, and water blasting are all regulated by the venturi blaster gun disclosed herein and without a pressurized tank the invention can execute one, any two, or all three of dry media blasting, slurry blasting, and water blasting.

With respect to the above description then, it is to be realized that material disclosed in the applicant's drawings and description may be modified in certain ways while still producing the same result claimed by the applicant. Such variations are deemed readily apparent and obvious to one skilled in the art, and all equivalent relationships to those illustrated in the drawings and equations and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact disclosure shown and described, and accordingly, all suitable modifications and equivalents may be resorted to, falling within the scope of the invention.

I claim:

1. A venturi media blaster assembly comprising:

a container adapted to hold at least one abrasive media, the container including an outlet connected to a first valve member, a first tube member having a first end and a second end, the first end of the first tube member being connected to the first valve member and the second end being adapted to allow ambient air to pass therethrough and a second tube member having a first end and a second end, the first end of the second tube member being attached to the first valve member and wherein the first valve member is adapted to allow ambient air to pass therethrough from the atmosphere;

an external air source having an air supply tube having an air outlet and an air inlet, the air outlet being connected to the external air source;

a reservoir adapted to hold water, the reservoir having a reservoir tube including a first end and a second end, the first end being connected to the reservoir;

a venturi blaster gun comprising:

an exterior nozzle having a proximal end and a distal end;

a media blaster assembly attached to the proximal end of the exterior nozzle, the media blaster assembly comprising:

a top wall;

a bottom wall having a first inlet connected to the air inlet of the air supply tube to receive air from the external air source, a second inlet connected to the second end of the second tube member to receive the at least one abrasive media from the container via a second valve member, a third inlet connected to the second end of the reservoir tube to receive water from the reservoir via a third valve member;

a pair of left and right sidewalls, the left sidewall having an aperture and the right side wall having an aperture, the right and left apertures regulating the flow of media and water received from the second and third inlets of the bottom wall utilizing the second and third valve members respectively;

a left end wall having a left aperture, an interior wall having a first orifice connected to an interior nozzle that extends through the left aperture of the left end wall and the proximal end of the exterior nozzle to allow the flow of air from the first inlet of the bottom wall to the exterior nozzle, a second orifice adapted to allow the flow of media from the second inlet of the bottom wall to the exterior nozzle and a third orifice adapted to allow the flow of water from the third inlet of the bottom wall to the exterior nozzle; and whereby a fourth valve member is opened and pressurized air flows from the first inlet of the bottom wall through the interior nozzle, thereby creating a venturi effect for propelling the media and the water discharged from the second and third orifice to the exterior nozzle thereby mixing of the media and water to provide a spray of media and water.

2. The venturi media blaster of claim 1, wherein the air supply is provided to the venturi blaster gun, water and media are siphoned and mix them automatically within the exterior nozzle to create a spray of media and water.

3. A venturi media blaster assembly comprising:

a container adapted to hold at least one abrasive media, the container including an outlet connected to a first valve member, a first tube member having a first end and a second end, the first valve member adapted to allow ambient air to pass therethrough and a second tube member attached to the first valve member;

an external air source connected to an air supply tube;

a reservoir connected to a reservoir tube adaptable to hold water;

a venturi blaster gun comprising:

an exterior nozzle having a proximal end and a distal end;

a media blaster assembly attached to the proximal end of the exterior nozzle, the media blaster assembly comprising:

a top wall;

a bottom wall having a first inlet connected to the air supply tube to receive air from the external air source, a second inlet connected to the second tube member to receive the at least one abrasive media from the container via a second valve member, a third inlet connected to the reservoir tube to receive water from the reservoir via a third valve member;

a pair of left and right sidewalls, the left sidewall having an aperture and the right side wall having an aperture, the right and left apertures regulating the flow of media and water received from the second and third inlets of the bottom wall utilizing the second and third valve members respectively;

a left end wall having a left aperture, an interior wall having a first orifice with an interior nozzle that extends through the aperture of the left end wall and the proximal end of the exterior nozzle to allow the flow of air from the first inlet of the bottom wall to the exterior nozzle, a second orifice adapted to allow the flow of media from the second inlet of the bottom wall to the exterior nozzle and a third orifice adapted to allow the flow of water from the third inlet of the bottom wall to the exterior nozzle; and a right end wall adapted to receive a fourth valve member that is engaged to a spring plunger such that when the spring plunger is actuated, the fourth valve member is opened and pressurized air flows from the first inlet of the bottom wall through the interior nozzle thereby creating a venturi effect for propelling the media and the water discharged from the second and third orifice to the exterior nozzle thereby mixing of the media and water to provide a spray of media and water.

4. The venturi media blaster of claim 3 wherein the spray of media and water allows spraying and removal of all rough surface finishes and oxidation.

5. The venturi media blaster of claim 3, wherein a base of the container comprises a flow system which allows an inlet for the media, the first valve member being adapted to allow ambient air to pass therethrough from the atmosphere, and a connection to the venturi blaster gun.

* * * * *